United States Patent [19]

Wilson et al.

[11] Patent Number: 4,723,505

[45] Date of Patent: Feb. 9, 1988

[54] POWDER BOOTH

[75] Inventors: Scott T. Wilson, Bay Village; Richard D. Burke, Amherst; Kenneth A. Kreeger, Avon Lake, all of Ohio

[73] Assignee: Nordson Corporation, Amherst, Ohio

[21] Appl. No.: 840,598

[22] Filed: Mar. 17, 1986

[51] Int. Cl.[4] ..... B05B 15/12

[52] U.S. Cl. ..... 118/326; 98/115.2; 55/341 HM; 55/356; 118/DIG. 7

[58] Field of Search ..... 98/115.2; 118/326, 634; 55/341 HM, 356

[56] References Cited

U.S. PATENT DOCUMENTS

| | | | |
|---|---|---|---|
| 3,204,390 | 9/1975 | Heyl | 55/341 HMB |
| 3,370,404 | 2/1968 | Leeper | 98/115 SB |
| 3,719,030 | 3/1973 | Blankemeyer et al. | 55/356 |
| 3,814,002 | 6/1974 | Rombach et al. | 98/115.2 |
| 3,905,785 | 9/1975 | Fabre | 55/96 |
| 4,094,654 | 6/1978 | Prinzing | 118/634 X |
| 4,133,255 | 1/1979 | Guice | 118/326 X |
| 4,277,260 | 7/1981 | Browning | 118/326 X |
| 4,354,451 | 10/1982 | Vohringer et al. | 118/326 |
| 4,378,728 | 4/1953 | Berkmann | 118/634 X |
| 4,395,269 | 7/1983 | Schuler | 55/302 |
| 4,454,832 | 6/1984 | Gernez | 118/634 |
| 4,471,715 | 9/1984 | Gubler et al. | 118/634 X |
| 4,498,913 | 2/1985 | Tank et al. | 55/356 |
| 4,504,292 | 3/1985 | Vohringer | 55/325 |
| 4,506,625 | 3/1985 | Vohringer | 118/312 |
| 4,545,324 | 10/1985 | Browing | 118/634 |

FOREIGN PATENT DOCUMENTS

| | | | |
|---|---|---|---|
| 2088744 | 6/1982 | United Kingdom | 55/341 HM |

*Primary Examiner*—Shrive P. Beck

*Attorney, Agent, or Firm*—Wood, Herron & Evans

[57] ABSTRACT

A powder spray booth including a tunnel through which product is conveyed to spray guns mounted adjacent the tunnel to spray charged particles into the tunnel and a fan and final filters located below the tunnel. A powder collector consisting of cartridges and a hopper below the cartridges is removably positionable at the downstream end of the tunnel.

11 Claims, 4 Drawing Figures

POWDER BOOTH

This invention relates to a powder booth and more particularly the invention relates to a powder booth having an improved arrangement for collecting oversprayed powder particles and returning them to spray guns associated with the powder booth.

Powder booths have certain basic components, including a tunnel, a conveyor for carrying product through the tunnel and spray guns for delivering charged particles toward the product. Different types of arrangements have been provided for collecting the oversprayed particles, that is the particles which do not adhere to the product, and returning those particles to the spray guns. One such system provides for interchangeable powder collectors which are moved into position under or adjacent to the tunnel to provide at least a first stage of collecting oversprayed particles. Interchangeable collectors are proposed in order to permit color changes to be made in the powder sprayed in the booth. The powder booth systems generally have components positioned around the floor space adjacent the spray booth with pneumatic conveyors for conveying powder to and from the various components. While it is difficult to create a generalization as to the deficiencies in existing systems, it can be said that they are lacking in efficiency, they are not very tidy and in general admit of the need for substantial improvement.

An objective of the present invention is to provide a powder booth which provides significant improvements over existing systems.

Another objective of this invention has been to provide a powder booth having an increased dwell time of the particles with respect to the product at which they are directed, thus providing a greater time for the charged particles to adhere to the product.

Another objective of the invention has been to provide a powder booth wherein the major components are integrated into a single package, including an interchangeable collector, with the electrical cables and pneumatic hoses all being contained within the package.

Another objective of the invention is to provide a spray booth having a removable interchangeable collector which can be moved into position from the end or from either side of the booth.

Another objective of the invention is to provide an improved collector system.

Another objective of the invention has been to provide a combined collector and recirculation system.

The objectives of the invention are attained by providing a spray booth having an elongated tunnel and having, underneath the upstream end of the tunnel a chamber for a fan and final filters. The downstream end of the tunnel is cantilevered over the floor. A powder collector is adapted to be rolled under the cantilevered tunnel section from the end or from either side of the powder booth. When in position, the overall configuration is such that the powder introduced at the upstream end of the tunnel by spray guns mounted there is in more or less quiet air. Being charged, the particles tend to move toward and dwell in the area of the product as the grounded product is moved through the tunnel. Since the collector, with air flowing into it, is located at the downstream end of the tunnel, the upstream end remains relatively free of air currents.

The collector has mounted on it a sieve and a recirculation hopper. Thus, the powder that is deposited into a hopper at the bottom of the collector is pneumatically conveyed a very short distance to a recirculation hopper mounted adjacent the collector hopper. From the recirculation hopper the powder can be directed immediately to the spray guns.

The control panels for the electrical and pneumatic systems are mounted on either side of the chamber at the upstream end of the tunnel. Thus, the cables and hoses which formerly had been strewn around the floor surrounding the powder booth are all contained within the spray booth structure.

The several features and objectives of the present invention will become more readily apparent from the following detailed description taken in conjunction with the accompanying drawings in which.

Figure 1:
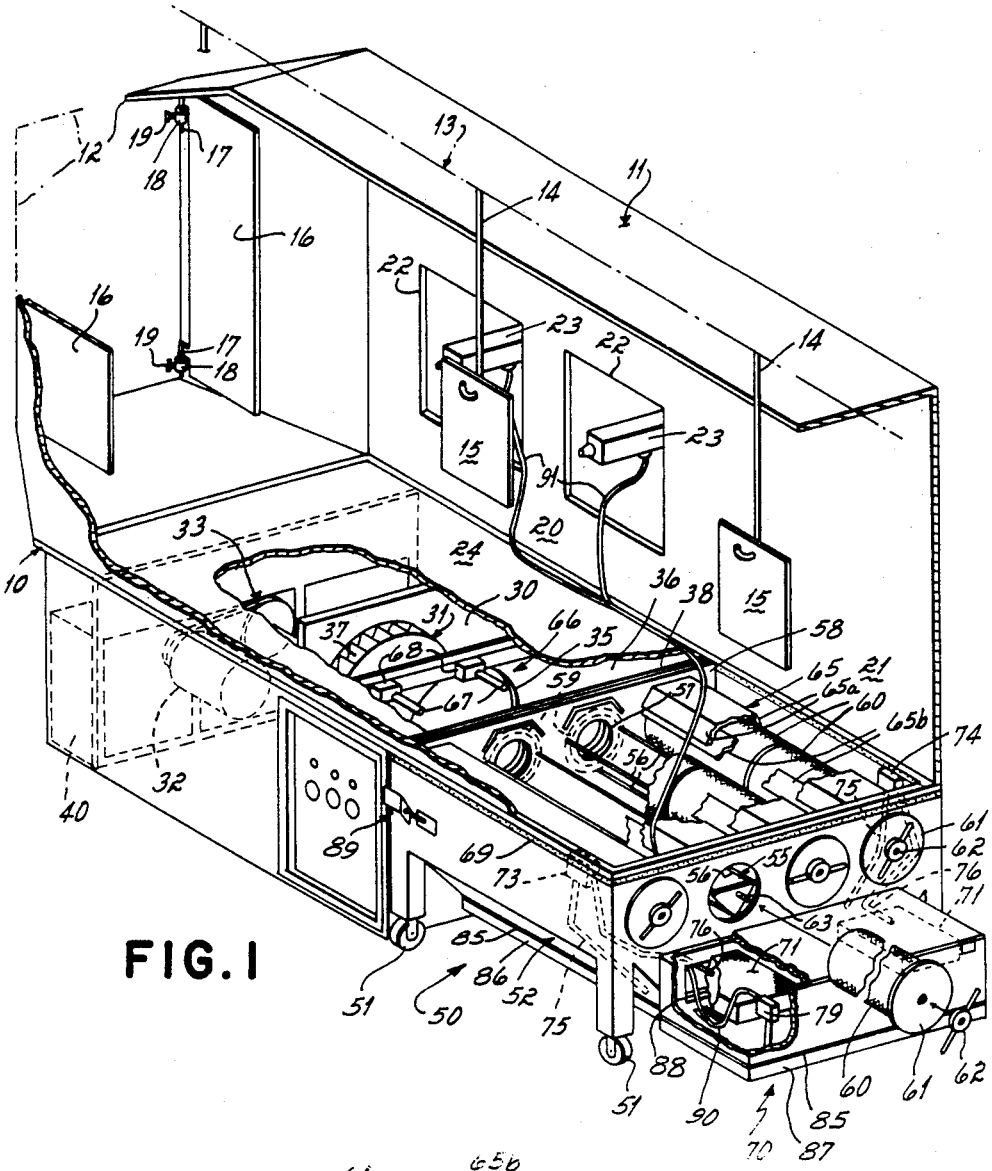
FIG. 1 is a perspective view of the invention.
Figure 4:
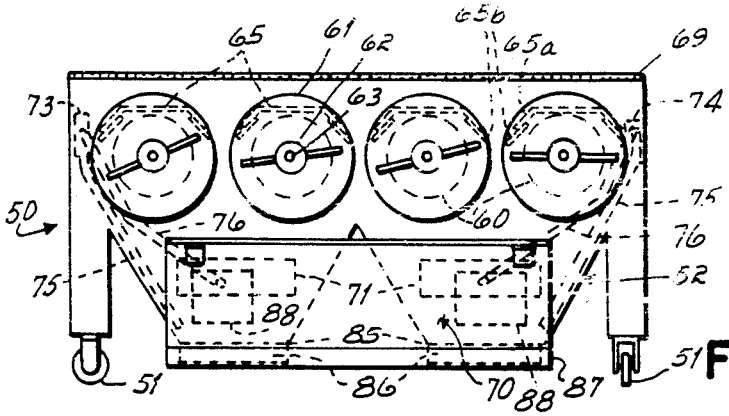
FIG. 4 is an end elevational view of the invention with the tunnel removed.
Figure 2:
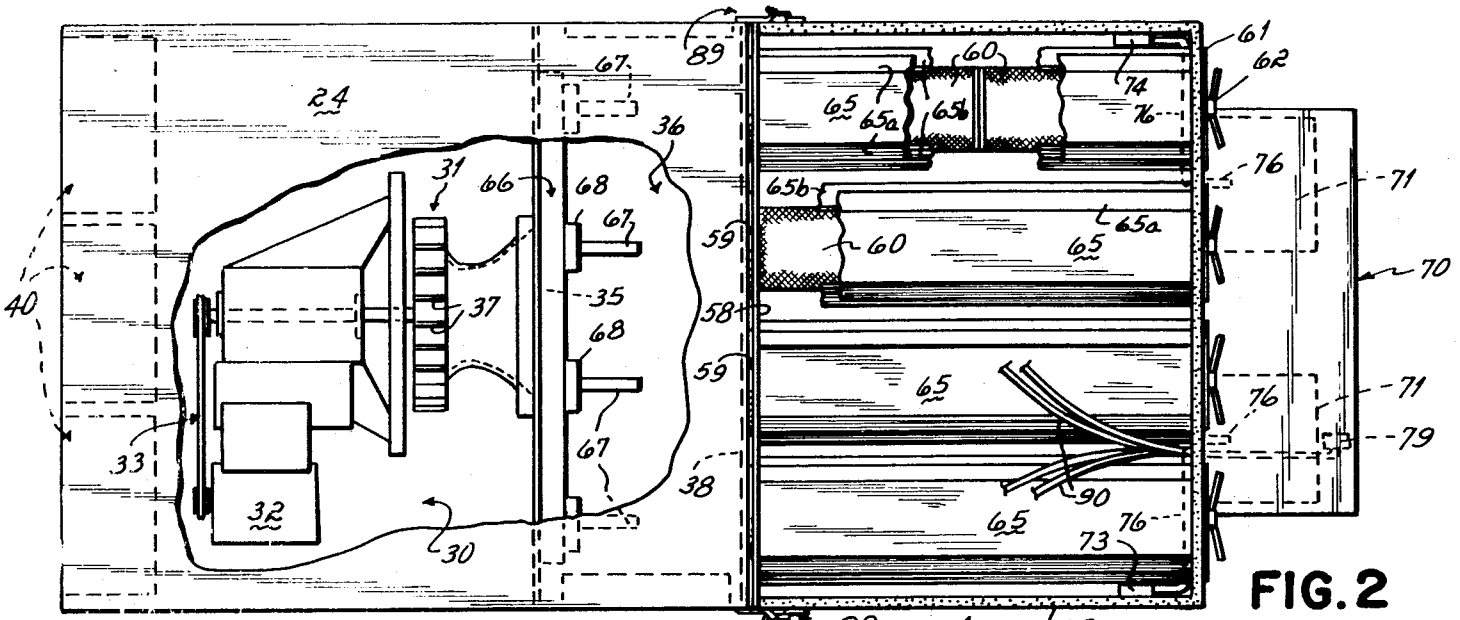
FIG. 2 is a top plan view of the invention with the spray tunnel removed.
Figure 3:
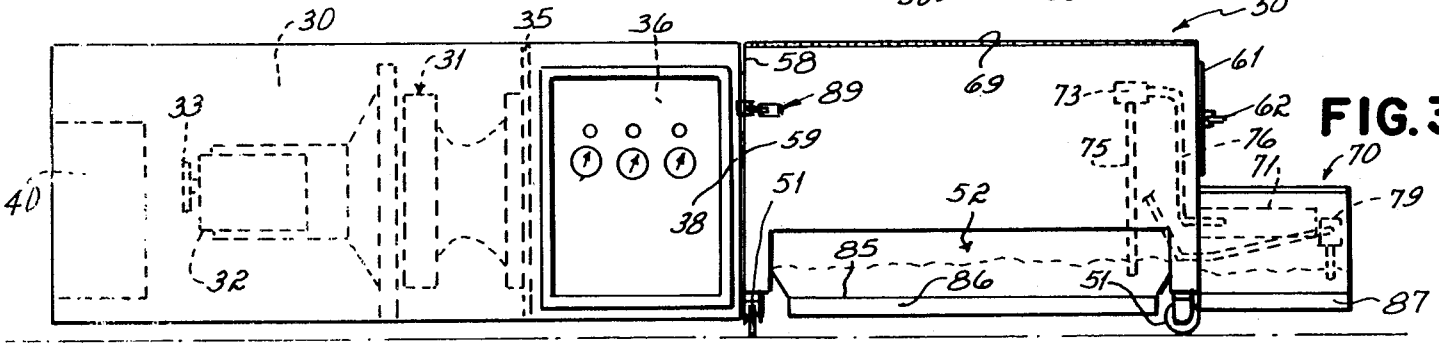
FIG. 3 is a side elevational view of the invention with the tunnel removed.

Referring to FIG. 1, there is a sort of rectangular frame 10 upon which a tunnel 11 is supported. The tunnel has an upstream window 12 and a corresponding downstream window through which a conveyor 13 having brackets 14 supporting product 15 to be sprayed passes. Positioned alongside each upstream and downstream window are a pair of adjustable baffles 16. Each baffle has downwardly-directed pins 17 along its edge, the pins passing through sleeves 18, fixed to the tunnel so that the baffles are pivotally mounted. A set screw 19, associated with sleeve 18, permits the baffle to be set at a desired position. The baffles provide assurance that there is a continuous low velocity movement of air through the upstream and downstream windows 12, thereby providing assurance that there is no escape of powder through those windows as might occur when foreign breezes pass into the plant. The baffles are adjustable so that the operator can adjust the conditions of operation to take into consideration the need for low velocity air to enter the tunnel, on the one hand, and to create an atmosphere as still as possible around the product that is being operated on the other hand. The tunnel may be considered to have an upstream section 20 and a downstream section 21. In the upstream section the tunnel has a pair of windows 22 through which spray guns 23 project. A steel plate 24 overlies the bottom of the upstream portion of the tunnel.

Underneath the upstream portion of the tunnel is a chamber 30 containing a radial fan 31 and a motor 32. The motor drives the fan through belt and pulley section 33. The fan is connected through an opening 35 to an intermittent chamber 36 and draws air from that intermittent chamber 36 through an opening 35 and directs it radially outwardly through the radial fins 37 of the fan. The chamber 36 has a downstream wall 38. The wall 38 has four holes 39 through which air is drawn, as will be discussed below.

A plurality of final filters 40 are located at the upstream end of the chamber 30. The air emanating from the fan 31 passes through those filters where final particles are picked up before the clean air enters the air surrounding the spray booth.

A collector 50 is mounted on wheels 51 which are preferably vertically-adjustable casters so that the collector can be moved into the position shown underneath the downstream end 21 of the tunnel. It can be moved longitudinally into position from the end of the tunnel or laterally from either side of the tunnel. This is advantageous in allowing some flexibility in plant layout.

The collector has the hopper 52 at the bottom of the collector. The collector has a plurality of triangular towers 55 which are horizontally-mounted across the upper portion of the collector. Each tower consists of three poles 56 whose ends are secured around a respective opening 57 formed in an upstream wall 58 of the collector. Eight cartridges 60, two to a tower 55, are mounted in the collector. They are secured in position by the plates 61 and the wing nuts 62 at the end of each cartridge which cooperate with bolts 63 on the ends of the towers 55.

Trapezoidal plates 65 which are horizontal and spaced from each other overlie the cartridges. They cause the particles to spill over to the sides and bottom of the cartridges and eliminate substantial adherence of particles to the top of the cartridges.

Each of the trapezoidal plates 65 has a downwardly-angulated flange **65*a* on each side of the plate so that the plate straddles the respective cartridge. On the underside of each flange is a longitudinal plate 65*b* which is vertically-adjustable with respect to the flange 65*a*. It can be observed that by dropping the plates 65*b*** between two cartridges, the longitudinal slot formed between the plates will be decreased in width. This will decrease the airflow in that section and increase the airflow between other cartridges. Thus, the adjustable plates provide the capability of varying the distribution of airflow and, hence, overspray powder to the respective cartridges.

A system of reverse pulsing jets 66 is mounted in the chamber 36 and include a nozzle 67 aligned with each cartridge unit. Valves 68 are provided to permit sequential reverse pulsing of the cartridges.

The castered wheels 51 of the collector 50 are vertically adjustable. The vertically-adjustable wheels assist in the alignment of the cartridge openings 57 with the openings 39 in the downstream wall 38 of chamber 36. A resilient gasket 59 made, for example, of foam, surrounds the opening 57. It may be mounted on the collector or mounted on the wall 38. It provides an airtight seal between the chamber 36 and the collector when the collector has been rolled into its position under the tunnel 13. A U-shaped, inflatable tube 69 is mounted on the underside of the downstream end of frame 10. When the collector is in place, as shown in FIG. 1, the tube 69 is inflated to form an airtight seal between the tunnel and the collector.

As is well-known in powder collectors, dust collectors and the like, particles are permitted to adhere to the surface of the cartridges. The powder is drawn to those surfaces by the fan whose low pressure end is connected to the chamber 36 thereby drawing air from the atmosphere surrounding the cartridges through the cartridges and into the chamber 36. At regular intervals, a reverse pulse of air is blasted through each cartridge to blow off the particles adhered to the surface of the cartridges, those particles dropping down into the hopper 52 at the bottom of the collector.

Downstream of the collector is a recirculation hopper 70. Recirculation hopper 70 is a rectangular container mounted on the collector 50. It is closed on top in order to form a sealed compartment. The recirculation hopper 70 has a pair of rectangular sieves 71 overlying its upper end. Left and right pumps 73 and 74 are connected by hoses 75 to the hopper 52 and are connected by hoses 76 to the sieve 71. Thus, the pumps suck powder out of the hopper 52 and drive it into the sieves 71. The sieves 71 function to strain out impurities which may have collected in the powder and permit reuseable powder to drop into a recirculation hopper 70.

To keep the powder loose and flowable, the collector hopper and the recirculation hopper are provided with fluidization plates 85. The pneumatic system automatically connects high pressure air to the air plenum chambers 86 and 87 below the collector and recirculation fluidization plates respectively so as to provide air which blows gently through the powder keeping it in a flowable state for transfer as described.

The recirculation hopper 70 has four pumps, one being shown. Each pump functions to withdraw fluidized powder from the hopper and deliver it to a spray gun 23. The hopper 70 is connected by a rectangular hole 88 to the recirculation hopper so that overflow powder may flow from the recirculation hopper 70 to the collector hopper 52. Each pump 79 has four hoses 90, each of which is connectable to a gun 23. Thus, the system is capable of mounting 16 guns. The hoses from the pump are passed through the opening 88. The hoses 90 lie on top of the plates 65 in the collector section and have free ends 91 which are connectable to respective guns 23, the ends passing through the openings 22.

The rectangular openings 88 also serve as openings through which the hoses from the pumps 73 pass into the recirculation hopper 70.

In the operation of the system, a collector with its recirculation container is moved into position under the downstream end of the tunnel 21 and secured there by latches 89. The fan 31 is energized to suck air through the cartridges 60 and blow it out through the final filters 40. The reverse jets are operated to direct a reverse jet blast of air into the cartridges at regular intervals. Powder is delivered to the guns 23 while product 15 is conveyed past the guns. The powder particles from the guns are directed toward the grounded products. The products move over the plate 24, where there is relatively little movement of air. Hence, the powder particles have a longer dwell time in which to adhere to the product, thereby increasing the effienciency of the powder transferred from the guns to the product.

As the product moves over the cartridges, the flow of air will increase because of the operation of the fan 31. Adhered overspray will descend against the cartridges. Because of the plates 65, those powder particles can only engage the sides and lower surfaces of the cartridges. Then when the cartridge is reversed pulsed powder will drift off the sides into the hopper below. From the hopper below the powder is pumped into the sieve and into the recirculation hopper and from the recirculation hopper the powder is pumped to the guns.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

Having described our invention, we claim:

1. A powder booth comprising, means forming a tunnel through which product is conveyed, a chamber adjacent said tunnel containing a fan and final filters, a collector section mounted on wheels for movement into communication with said fan, said collector section having a plurality of horizontal cartridges disposed side-by-side and a hopper below said cartridges, and plates overlying said cartridges to force powder particles to flow to the side and under surfaces of said cartridges, said plates being adjustable to vary the distribution of air and powder particles from side to side.

2. A booth as in claim 1 in which said cartridges are cylindrical and are mounted side-by-side in said collector section on horizontal axes, said plates being spaced and parallel to each other, one plate overlying each cartridge.

3. A booth as in claim 1 in which said cartridges are cylindrical and are mounted side-by-side in said collector section on horizontal axes, said plates being spaced and parallel to each other, one plate overlying each cartridge, each said plate having a longitudinal downwardly-angulated flange overlying each cartridge, and a longitudinal plate adjustably mounted on each said flange whereby the gaps between adjacent plates may be adjusted to modify the flow of air to said cartridges.

4. A powder booth comprising, a frame supported above a floor, a tunnel mounted above said frame, a conveyor for conveying product longitudinally through said tunnel, a chamber below the upstream end of said tunnel, a fan and final filters in said chamber, said tunnel having a downstream end cantilevered over said floor, a powder collector section having floor engaging wheels adapting it to be rolled under the downstream end of said tunnel, said collector section having cartridge filters exposed to the downstream end of said tunnel and being in communication with the low pressure end of said fan and spray guns in the upstream end of said tunnel for spraying powder at conveyed products, whereby the air in the upstream end of said tunnel is relatively quiet permitting powder a long dwell time to adhere to the product, the oversprayed powder being drawn onto said cartridge filters at the downstream end of said tunnel.

5. A powder booth comprising means forming a tunnel through which product is conveyed, spray guns associated with said tunnel, a chamber adjacent said tunnel containing a fan and final filters, a collector section mounted on wheels for movement into communication with said fan, said collector section having a plurality of cartridges and a hopper below said cartridges, a recirculation hopper adjacent said collector section, means below each hopper creating fluidizing bed of powder in each hopper, a sieve overlying said recirculation hopper, first pump means transferring powder from said cartridge hopper to said sieve, and second pump means conveying powder from said recirculation hopper to said spray guns.

6. A powder booth as in claim 5 in which said first pump means comprises a pump on each side of said cartridge hopper, a tube connecting the low pressure side of each said pump to said fluidizing bed of said cartridge hopper and a tube connecting the high pressure side of said pump to the interior of said sieve.

7. A powder booth as in claim 6 in which said second pump means comprises a plurality of pumps mounted adjacent said recirculation hopper and have inlets connected to the fluidizing bed of said recirculating hopper.

8. A powder booth comprising, a frame supported above a floor, a tunnel mounted above said frame, said tunnel having an upstream end, a conveyor for conveying product longitudinally through said tunnel, a chamber below the upstream end of said tunnel, a fan and final filters in said chamber, said tunnel and frame having a downstream end cantilevered over said floor, a power collector section having a plurality of cartridge filters, castered wheels engageable with the floor and supporting said collector section above the floor, said collector section being movable into position below said tunnel under said cantilevered end and adjacent said chamber from the end or either side of said tunnel.

said fan creating an airflow entering into the tunnel at its upstream end and reversing through 180° at the downstream end and returning under the tunnel to exit at the upstream end, with consequent saving in floor space.

9. A powder booth as in claim 8 in which said castered wheels are vertically-adjustable to permit alignment of said collector section with the frame above and with openings in said fan chamber.

10. A powder booth as in claim 8 further comprising, an inflatable gasket between said frame and said collector section.

11. A powder booth as in claim 8 in which said chamber has a vertical downstream wall adjacent said collector section, said downstream wall having a plurality of openings each alignable with a cartridge filter, and a gasket surrounding each said opening and forming a seal between said downstream wall and said collector section.

* * * * *

UNITED STATES PATENT AND TRADEMARK OFFICE

CERTIFICATE OF CORRECTION

PATENT NO. : 4,723,505

DATED : February 9, 1988

INVENTOR(S) : Scott T. Wilson, Richard D. Burke, Kenneth A. Kreeger

It is certified that error appears in the above-identified patent and that said Letters Patent is hereby corrected as shown below:

Column 4, line 44, "effienciency" should be -- efficiency --

Column 6, line 31, "power" should be -- powder --

Signed and Sealed this

Second Day of August, 1988

*Attest:*

DONALD J. QUIGG

*Attesting Officer*

*Commissioner of Patents and Trademarks*